United States Patent [19]

Kumar

[11] Patent Number: 4,946,570

[45] Date of Patent: Aug. 7, 1990

[54] CERAMIC COATED STRIP ANODE FOR CATHODIC PROTECTION

[75] Inventor: Ashok Kumar, Champaign, Ill.

[73] Assignee: The United States of America as represented by the Secretary of the Army, Washington, D.C.

[21] Appl. No.: 316,703

[22] Filed: Feb. 28, 1989

[51] Int. Cl.[5] ..... C23F 13/00

[52] U.S. Cl. ..... 204/196; 204/279; 204/280; 204/286; 204/290 F; 204/297 R

[58] Field of Search ..... 204/147, 148, 196, 197, 204/280, 286, 297 R, 290 F, 279

[56] References Cited

U.S. PATENT DOCUMENTS

| | | | |
|---|---|---|---|
| 3,133,872 | 5/1964 | Miller et al. | 204/196 |
| 3,349,017 | 10/1967 | Ziegler | 204/197 |
| 3,718,570 | 2/1973 | Geld | 204/196 |
| 3,846,273 | 11/1974 | Bianchi et al. | 204/290 F |
| 3,850,701 | 11/1974 | Itai et al. | 148/6.35 |
| 3,948,751 | 4/1976 | Bianchi et al. | 204/290 F |
| 4,112,140 | 9/1978 | Heikel et al. | 427/126 |
| 4,169,028 | 9/1979 | Yokoyama et al. | 204/147 |
| 4,187,164 | 5/1980 | Warne | 204/196 |
| 4,214,971 | 7/1980 | Heikel et al. | 204/290 F |
| 4,223,049 | 9/1980 | Murray et al. | 427/126 |
| 4,406,757 | 9/1983 | Huang | 204/58 |
| 4,422,917 | 12/1983 | Hayfield | 204/196 |
| 4,445,989 | 5/1984 | Kumar et al. | 204/147 |
| 4,585,540 | 4/1986 | Beer et al. | 204/290 F |
| 4,589,959 | 5/1986 | Nakamatsu et al. | 204/28 |
| 4,626,334 | 12/1986 | Ohe et al. | 204/290 R |

FOREIGN PATENT DOCUMENTS

| | | | |
|---|---|---|---|
| 614799 | 12/1948 | United Kingdom | 204/196 |
| 927232 | 5/1963 | United Kingdom | 204/196 |
| 2118974A | 11/1983 | United Kingdom | 204/196 |

OTHER PUBLICATIONS

Kumar et al, "Pipe Corrosion Monitor", Corrosion 83, Paper No. 254, Nat. Asso. of Corrosion Engrs., Anaheim, Calif., Apr. 18–22, 1983, pp. 254/1–254/6.

Ashok Kumar & Jeffrey Boy, "New Developments in the Ceramic Anode for Cathodic Protection", Corrosion 86, Paper No. 288, National Association of Corrosion Engineers, Houston, Tex., Mar. 17–21, 1986, pp. 288/1–288/7.

Ashok Kumar & Mark Armstrong, "New Cathodic Protection Designs Using Ceramic Anodes–For Navigation Lock Gates", Corrosion 87, Paper No. 71, San Francisco, Calif., Mar. 9–13, 1987, National Association of Engineers, pp. 71/1–71/10.

Hock et al., "Fabrication of Electrically Conductive Metal Oxide Coatings by Reactive Ion Plating," Journal of Vacuum Science Technology, vol. 3, No. 6, Nov./Dec. 1985, pp. 2661–2664.

Kumar et al., "Corrosion Control of Pilings in Seawater;" Buzzards Bay, Mass., Corrosion 84, Paper No. 345, National Association of Corrosion Engineers, New Orleans, La., Apr. 2–6, 1984, pp. 345–345/13.

Hock et al., "Structure, Chemistry, and Properties of Mixed Metal Oxides", Corrosion 88, Paper No. 230, National Association of Corrosion Engineers, St. Louis, Mo., Mar. 21–25, 1988, pp. 230–230/10.

*Primary Examiner*—T. Tung

*Attorney, Agent, or Firm*—Darrell E. Hollis

[57] ABSTRACT

An elongated anode, comprising an electrically conductive ceramic material coated on a valve metal substrate, is secured in a correspondingly elongated groove which extends longitudinally in a shield of electrically nonconductive material. The shield has a convex outer surface when viewed in a plane perpendicular to its longitudinal axis. The shield can be a longitudinal segment of a cylindrical thermoplastic pipe containing spirally wound reinforcing filaments. The interior space of the annular segment can be filled with a resilient material to provide a cushion.

30 Claims, 2 Drawing Sheets

CERAMIC COATED STRIP ANODE FOR CATHODIC PROTECTION

STATEMENT OF GOVERNMENT INTEREST

The invention described and claimed herein may be manufactured and used by or for the Government of the United States of America for governmental purposes without the payment of royalties thereon or therefor.

FIELD OF THE INVENTION

The invention relates to cathodic protection for structures which are in contact with water. In a specific aspect, the invention relates to cathodic protection anodes for installation on underwater structures such as a lock and dam or a water tank. In another aspect, the invention relates to a cathodic protection anode structure which has improved throwing power for a given quantity of active anode. In yet another aspect, the invention relates to a ceramic coated, elongated strip anode with lower electrolyte resistance and power consumption useful for cathodic protection of the surfaces of underwater structures.

BACKGROUND OF THE INVENTION

Cathodic protection has been used since 1824, when it was introduced by Sir Humphrey Davy as a way to protect copper sheathing in ships. More recently, cathodic protection has been used by the U.S. Army Corps of Engineers on lock gates on the Mississippi River to extend the effective life of paint coatings and to provide supplemental protection to defects in the paint film on immersed steel surfaces. The paint film, which is a hydraulic structure's primary protection against corrosion, is never perfect as defects and holidays are always present, and hard-to-paint areas such as edges, rivet heads, and weld beads may never receive adequate paint protection. In addition, paint film is scratched by debris and barge traffic on the waterways; the exposed steel then corrodes until repainted or repaired.

Most hydraulic structures are dewatered only every 10 to 15 years to inspect seals and pintels, and for general inspection and any needed repainting. Cathodic protection can provide supplemental protection to inadequately painted and/or scratched areas between dewatering cycles. Cathodic protection provides supplemental protection to paint coatings and thereby extends the life of the coatings. Furthermore, it decreases the time the structure must be out of service during interim inspections and can increase the total life of the structure.

The two basic types of cathodic protection anodes are sacrificial anodes and impressed current anodes. The sacrificial anode, which is attached to the metal structure to be protected, slowly dissolves to release electrons which flow to the metal structure to maintain the metal structure as a cathode, thereby protecting the metal structure. The impressed current anode preferably has a very low dissolution rate as the protection of the metal structure is achieved through the application of an impressed current from an external source to the anode.

Often, due to shortcomings in the anode materials and/or the configurations used, sacrificial and impressed current cathodic protection systems fail to operate effectively in mitigating corrosion. Sacrificial anodes normally have high material dissolution rates and therefore can corrode away before routine maintenance of the cathodic protection system can take place (i.e., during the dewatering cycle of a hydraulic structure). The "throwing power" of the sacrificial anodes is often insufficient to protect reasonable sized areas of the structure when the resistance of the water is greater than 3000 ohms-cm. In response to these problems, a large number of heavy bulky anodes must often be used for protection, putting a great deal of strain on structural supports and operating equipment. The large anodes are prone to installation problems because of their size and weight. They are also vulnerable to mechanical damage from floating debris or ice.

Anodes used in impressed current cathodic protection systems also have fundamental problems. Graphite anodes, over a period of time, undergo "degraphitization", where the binder material present in the anode is leached out, leaving behind a porous material that occupies the same column as the original anode. As the anode become less dense, the electrical connections fail, even in less severe environments. Silicon-iron anodes also have difficulties with their electrical connections. Anode connections made during installation do not provide adequate electrical isolation from the cathodically protected structure, and therefore electrical shorting takes place. In addition, graphite and silicon-iron anodes are still necessarily heavy (anodes weighing 18 lbs or more are common) due to their relatively high dissolution rates; this makes anode installation extremely difficult in most situations. Because of their size, graphite and silicon-iron anodes are also quite susceptible to mechanical damage in situations where ice and/or floating debris is present.

Platinized anodes consisting of a thin layer of a platinum group metal or oxide on a valve metal substrate such as titanium, niobium, hafnium, tantalum and alloys thereof are also available. The platinum group metals include platinum, ruthenium, osmium, and iridium. However, they are expensive and the thin coating is susceptible to erosion or abrasion damage in high velocity water. Furthermore, dissolution is accelerated by the AC ripple effect imposed by the rectifier.

U.S. Pat. No. 4,187,164 discloses a button of titanium or niobium partially imbedded in plastic material, with a layer of platinum on the exposed face of the button. The patentee noted that such construction is difficult to manufacture, and further that long, thin cathodic protection anodes are more effective than short, fat ones. The patentee indicated that long, thin anodes are difficult to mount and that it had been the practice to produce anodes assemblies which can be mounted in plastic material, such as the undulating wire anode, the rectangular bar having bat-wing plates attached along its length, and the rod or tubular anode. The patentee proposed a roll-formed titanium strip having a central U-shaped spine and longitudinally extending flanges, with the platinum or other active anode component being coated only along the convex spine. However, this latter design requires a substantial amount of expensive titanium to provide the uncoated portion of the spine and the flanges in comparison to the small extent of the platinized portion of the spine.

Conducting ceramic coatings are a relatively new concept in the field of impressed current anodes. The conducting ceramic anode coating must provide an effective barrier to oxygen ions, so that the substrate metal does not become oxidized. In addition, the ceramic coating must have a relatively high electron conductivity on active surface area for oxidation to occur, be mechanically strong and have good adherence to the substrate. U.S. Pat. No. 3,850,701 describes the use of a magnetite coating which was chemically processed over a titanium or tantalum substrate. However, the resulting coating had insufficient adhesion to the substrate.

U.S. Pat. No. 4,445,989 discloses the use of a second type of ceramic anode. It employs a cathodic anode comprising an electrically conducting ceramic coating on a valve metal substrate, where the consumption rate of the ceramic coating is on the order of 1 gram per ampere-year. The ceramic coating is approximately 10 to 20 mils thick and is produced by plasma spraying. The ceramic coating is either ferrite or chromite, while the preferred valve metal substrates are titanium and niobium.

U.S. Pat. Nos. 3,846,273 and 3,948,751 describe titanium or niobium metal substrates coated with niobium-doped titanium oxide by conventional techniques. U.S. Pat. Nos. 4,112,140 and 4,214,971 disclose a ruthenium oxidetitanium oxide coating on a valve metal substrate produced by conventional techniques.

Later it was discovered that composite anodes having excellent characteristics of low resistivity, very low dissolution rates, long life, durability, and corrosion resistance can be produced by reactive ion plating a thin layer of mixed metal oxides on a selfpassivating electrically conductive valve metal base. The mixed metal oxides are composed of transition metal oxides and/or noble metal oxides of the platinum group. The valve metal is generally titanium or niobium. Three preferred embodiments are a niobium-doped titanium oxide coating, a ruthenium oxide/titanium oxide mixture coating or a iridium oxide/titanium oxide mixture coating on a niobium or titanium valve metal substrate. The thickness of the coating is at least one micron and can be 50 microns or greater. The coating is preferably achieved by reactive ion plating in concert with predeposition sputter cleaning of the substrate surface.

In order to minimize, and preferably eliminate, some of the problems which have caused premature failures of cathodic protection systems, various configurations of ceramic coated impressed current anodes were developed by members of the U.S. Army Construction Engineering Research Laboratory. Paper No. 288, entitled "New Developments in the Ceramic Anode for Cathodic Protection," by Ashok Kumar and Jeffrey Boy, presented at Corrosion 86, Houston, Texas, discloses a new flat titanium plate with a mixed metal oxide coating. The plate was positioned in a polyurethane shield for protection against damaging effects of impacts. While the shield left the coated anode face exposed, it protected the perimeter and the uncoated back of the plate.

Paper No. 71, entitled "New Cathodic Protection Designs Using Ceramic Anodes - For Navigation Lock Gates," by Ashok Kumar and Mark Armstrong, presented at Corrosion 87, San Francisco, California, discloses an improved version of the ceramic coated plate anode. A five inch flat disc, of titanium having a coating of ruthenium oxide/titanium oxide ceramic material on the exposed face, is mounted in the recessed center of a twelve inch fiber reinforced plastic saucer. The space defined by the concave surfaces on the backside of the saucer is filled with polyurethane to provide shock absorbence, as is the space between the backside of the titanium disk and the front side of the saucer. A fiberglass reinforced plastic bolt with a titanium core is used to mount the flat disk anode. The cable to anode connection is made through gold plated titanium pins in a water-tight plug. While this disk electrode does not project outwardly from the hydraulic structure as far as most sacrificial anodes or impressed current button electrodes, it does have a concentrated area of active anode surface. Thus, any damage caused by abrading or impacting contact of ice or debris with the active ceramic anode surface can inactivate a substantial portion of the active anode area.

SUMMARY OF THE INVENTION

It is an object of the invention to provide a new and improved cathodic protection device for use with structures which are in contact with water. Another object of the invention is to provide a durable cathodic protection anode which has a low anode to electrolyte resistance. It is an object of the invention to provide a cathodic protection device which can provide a high current flow in relation to the active surface area of the anode. Another object of the invention is to provide a cathodic protection device which readily deflects ice and debris and has exceptional impact resistance. Yet another object of the invention is to provide a cathodic protection device which is light weight and flexible, and can be installed underwater on a hydraulic structure without having to dewater the hydraulic structure.

In accordance with the invention, the cathodic protection device comprises an elongated anode, having an electrically conductive ceramic material coated on a valve metal substrate, positioned in a correspondingly elongated groove which extends longitudinally in the outer surface of a shield of electrically non-conductive material The shield has a convex outer surface when viewed in a plane perpendicular to the longitudinal axis of the shield. The backside of the shield can be coated with a resilient material to provide a cushion for impact blows to the cathodic protection device. In a preferred embodiment, the shield is a longitudinal segment of a cylindrical pipe formed of spirally wound reinforcing filaments coated with a suitable thermoplastic material. The cathodic protection device is provided with means for mounting the device on a hydraulic structure, and means for applying a suitable voltage to the anode.

DETAILED DESCRIPTION OF THE INVENTION

Figure 1:
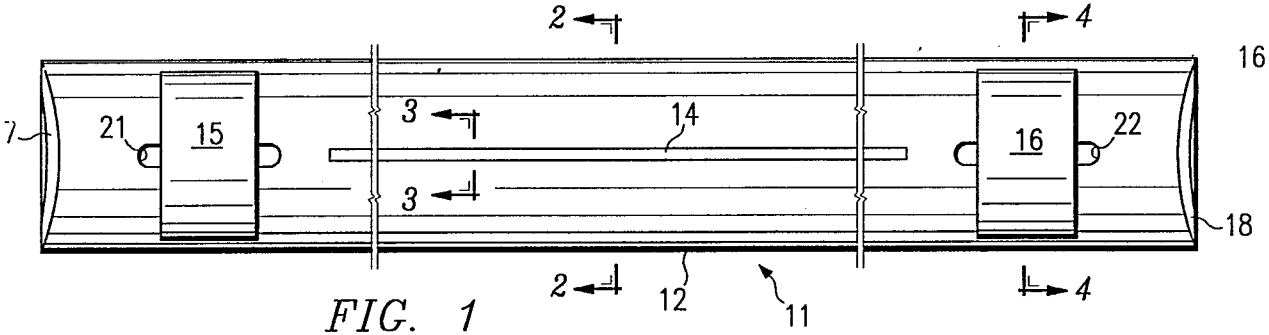
FIG. 1 is a top view of a cathodic protection anode in accordance with the invention.
Figure 2:
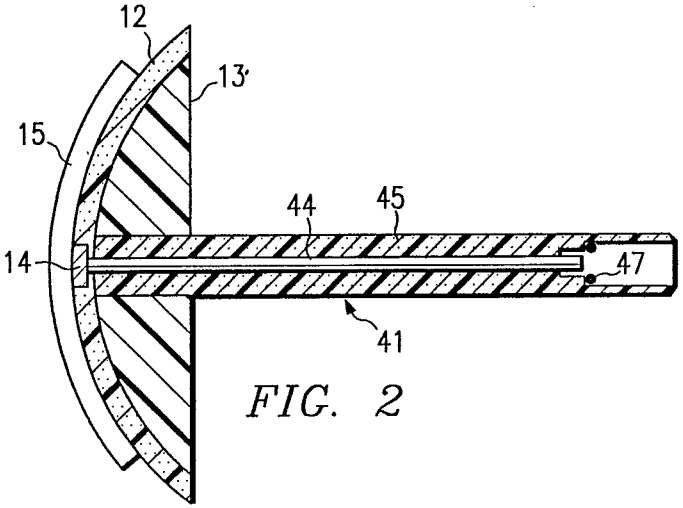
FIG. 2 is a cross-sectional view taken along line 2—2 in FIG. 1.

Referring now to FIGS. 1 and 2, the elongated cathodic protection device 11 comprises an exterior shield 12, resilient backing material 13, anode 14, mounting clamps 15 and 16. Shield 12 has a crosssectional configuration which permits flexing of the shield when impacted by ice or debris. In a presently preferred embodiment, shield 12 is a segment of a fiber reinforced plastic pipe having a cylindrical cross section, where the segment is formed by cutting the cylindrical pipe along a plane parallel to the longitudinal axis of the pipe. The angle of inclusion for the pipe segment will generally be in the range of about 30° to about 180°, but is preferably in the range of about 45° to about 120°. Thus, shield 12 has an outer convex surface and an inner concave surface when viewed in a plane perpendicular to the longitudinal axis of the pipe segment. The fiber reinforced pipe is preferably fabricated by spirally winding filaments of a suitable reinforcing material about a mandrel, impregnating the filaments with a suitable thermoplastic material, and forming the impregnated filaments into a tubular pipe having a very smooth exterior surface for minimum friction. The thermoplastic material and the filaments are electrically non-conductive materials.

The space defined by the interior concave surface of shield 12 and a plane through its lateral edges is at least partially filled with a suitable resilient material 12, with polyurethane being presently preferred. The longitudinal ends of the shield 12 can be beveled, as at 17 and 18, to reduce the possibility of ice or debris catching on the ends of the cathodic protection device 11. Thus, shield 12 and resilient material 13 provide a very strong, but resilient structure, with very high resistance to impact forces and very low resistance to the flow of ice or debris against the cathodic protection device.

Figure 5:
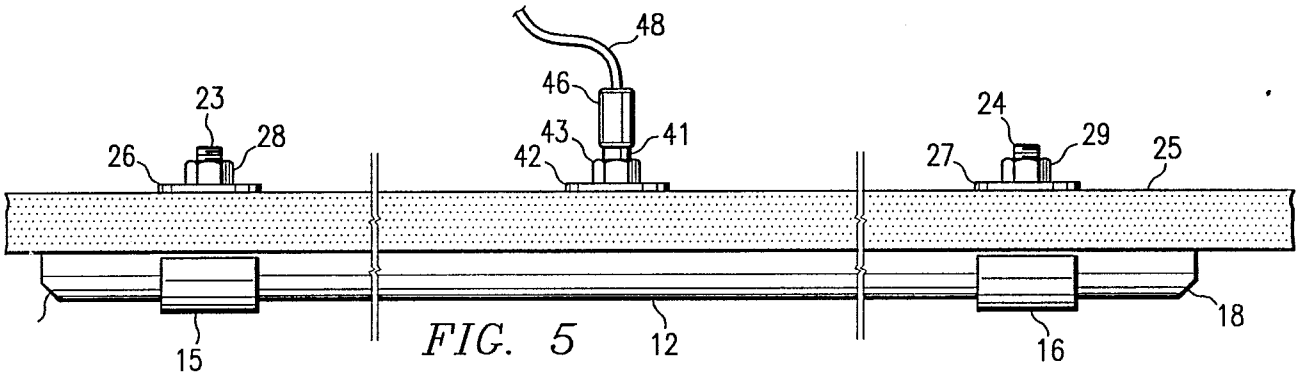
FIG. 5 is a side view of the anode mounted on a wall of a structure to be protected.
Figure 4:
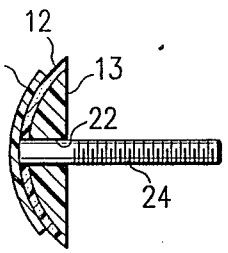
FIG. 4 is a cross-sectional view taken along line 4—4 in FIG. 1.

Slot openings 21 and 22 extend through shield 12 and resilient material 13 to permit the threaded bolts 23 and 24 of longitudinally adjustable clamps 15 and 16 to be inserted therethrough. As shown in FIG. 5, the bolts 23 and 24 also extend through openings (not shown) in hydraulic structure 25, and washers 26 and 27 and nuts 28 and 29 are applied to the free ends of bolts 23 and 24 to securely hold the cathodic protection device against hydraulic structure 25. Bolts 23 and 24 are formed of fiber reinforced plastic and are electrically non-conductive. The use of slot openings 21 and 22, instead of circular openings, permits greater leeway in the accuracy required for locating the bolt holes in the hydraulic structure, as well as permitting some flexibility for mounting the cathodic protection device on the surfaces of a hydraulic structure. Clamps 15 and 16 have inner concave surfaces which mate with the convex outer surface of shield 12. Clamps 15 and 16 have large areas of contact with shield 12 in order to minimize the stress on shield 12 if the cathodic protection device is hit a glancing blow by passing debris. The outer surface of clamps 15 and 16 are also convex, corresponding to the convex outer surface of shield 12 to reduce the opportunities for debris to snag on the cathodic protection device. If desired, the edges of clamps 15 and 16 can be beveled to further reduce resistance to passing debris.

Figure 3:
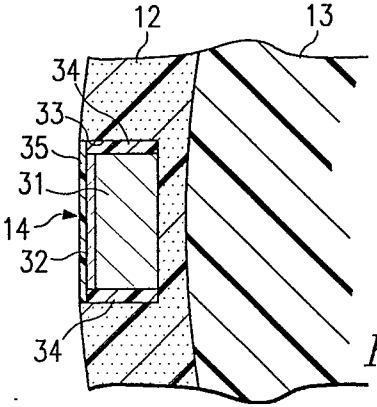
FIG. 3 is an enlarged fragmentary view of a cross section along line 3—3.

Referring now to FIGS. 1, 2 and 3, the anode element 14 is a elongated strip 31 of a suitable valve metal having an electrically conducting ceramic coating 32 on the outer surface thereof. The strip 31 can be formed as a solid bar of titanium, niobium, hafnium, tantalum, or alloys thereof or as a coating of such materials on a copper core. Of the valve metals, titanium is generally preferred because of its lower cost, unless the risk of chloride pitting dictates the use of niobium. Niobium can be used at voltages as high as 50 volts in salt water, although cathodic protection generally employs less than 25 volts. The protective coating on titanium breaks down when more than 10 volts are applied, and the titanium is susceptible to pitting when polarized to more than 10 volts in the presence of water containing relatively large concentration of chlorine. The ceramic coating 32 can be formed of any suitable electrically conductive ceramic material. In general, any mixture of transition metal oxides and/or noble metal oxides of the platinum group can be utilized, but ruthenium oxide and iridium oxide are presently preferred. Ruthenium oxide and iridium oxide exhibit metallic electrical conductivity over a wide range of temperatures, have very low resistivities and very low dissolution rates. Alloying ruthenium oxide or iridium oxide with titanium oxide provides a solid solution with increased chemical stability without significantly degrading the electrical conductivity. These materials are far more resistant to abrasion than platinum clad anodes. The presently preferred ceramic material is formed from a mixture of titanium oxide with iridium oxide and/or ruthenium oxide wherein the ruthenium and/or iridium constitutes from about 20 to about 80 percent of the metal atoms in the ceramic material while titanium constitutes from about 80 to about 20 percent of the metal atoms in the ceramic material. A particularly useful ceramic material has ruthenium or iridium constituting from about 40 to about 50 percent of the metal atoms with titanium constituting from about 60 to about 50 percent of the metal atoms. This ceramic material may be a mixed oxide of rutile titanium dioxide and either iridium oxide or ruthenium dioxide. Another suitable ceramic is a niobium-doped titanium oxide ceramic material generally having titanium constituting 90 to 99.5 percent of the metal atoms with niobium constituting from 10 to 0.5 percent of the metal atoms. The niobium-doped titanium dioxide may be a mixture of various niobium oxides or a solid solution of titanium dioxide with niobium atoms incorporated in the rutile lattice.

Mixed metal oxide anode layers can be fabricated by a variety of ceramic processing techniques. Iridium oxide or ruthenium oxide films a few microns thick can be deposited on inert metallic substrates at comparatively low temperatures by the decomposition of metal salt such as ruthenium chloride. Repeated painting and firing can be used to achieve the desired coating thickness. The ceramic coating is preferably applied by reactive ion plating one or more layers of the metal oxide on a titanium substrate. The ceramic coating will generally have a thickness in the range of about 0.001 inch to about 0.050 inch, while the valve metal will generally have a thickness in the range of about 0.05 inch to about 0.5 inch.

Anode bar 31 is positioned in an elongated groove 33 in the upper surface of shield 12. Grove 33 extends parallel to the longitudinal axis of shield 12, lies approximately midway between the longitudinal edges of shield 12, is slightly deeper than the thickness of bar 31 and coating 32, and is slightly wider than bar 31. Anode bar 31 is placed in groove 33 and then the remaining volume of groove 33 is filled with a suitable bonding agent 34, for example, an elastomeric material which will harden in situ, for example, polyurethane. The distance from the longitudinal edge of the anode bar 14 to the longitudinal edge of shield 12 represents the electrical shielding distance. Accordingly, the ends of slots 21 and 22, which are nearest to the anode bar 14, are separated from the adjacent end of the anode bar 14 by a distance which together with the depth of the slot is at least substantially as great as the distance from the longitudinal edges of the anode bar 14 to the adjacent longitudinal edge of the shield, in order to maintain the electrical shielding.

The ratio of the length of anode bar 14 to its width can be any desired value, but in general this ratio will be in the range of about 20:1 to 2000:1. This ratio is preferably in the range of about 50:1 to about 1000:1, with the ratio for currently produced units being in the range of about 100:1 to about 500:1.

Referring now to FIGS. 1, 2, and 5, a threaded connector stud 41 is attached to the backside of shield 12 and extends through an opening (not shown) in hydraulic structure 25. A washer 42 and nut 43 secures stud 41 to hydraulic structure 25. Stud 41 has a titanium core 44 encased in fiberglass reinforced plastic 45. The titanium core 44 of stud 41 is electrically connected to anode bar 14. An underwater replaceable compression connector (not shown) plugs into the hollow end of mounting stud 41 to make electrical contact with the titanium core in the mounting stud 41, while polyvinyl chloride compression cap 46 secures to the outside of stud 41 to provide protection for the connection. The compression connector is made of a valve metal, for example titanium or niobium with the female-male contact surfaces of the connector and core 44 being gold plated. O-rings 47 or other suitable sealing means can be provided within the connector and/or stud 41. Electrical cable 48 leads to a suitable power source. If desired, a diode (not shown) can be imbedded in the connector within cap 46 to provide a constant current at a constant voltage, or a four diode bridge circuit can be employed in combination with a rheostat to provide an adjustable current flow through cable 48.

In one model represented by FIGS. 1–5, bar 14 is 7 feet long by $\frac{1}{4}$ inch wide and $\frac{1}{8}$ inch deep and is formed of titanium with a coating formed from a mixture of ruthenium oxide and titanium oxide; shield 12 is a fiberglass reinforced polyester pipe segment 8 feet long with a width of $3\frac{3}{4}$ inches and a wall thickness of 0.4 inch, with the maximum protrusion from the surface on which it is mounted being $\frac{7}{8}$ inch; slots 21 and 22 are approximately 3 inches in length. This cathodic protection device had an anode area of 21.0 square inches, an electrolyte resistance of the anode of 30 ohms in 2500 ohm-cm resistive water, and a current output of 165 milliamps at an input voltage of 5 volts. In contrast, the 5 inch diameter disk anode had an anode area of 19.6 square inches, an electrolyte resistance of the anode of 116 ohms in 2500 ohm-cm resistive water, and a current output of 43 milliamps at an input voltage of 5 volts. For only 7% more area, the strip anode had a current output almost four times that of the disk anode. This strip anode cathodic protection device has exceptional impact resistance, mechanical strength, chemical resistance, and electrochemical durability. Its shape readily deflects debris and ice. To increase the throwing power or driving force of the strip anode, a flat auxiliary shield having a greater width than shield 12, for example, 12 inches, can be placed between shield 12 and structure 25, thereby increasing the effective electric shielding distance.

Figure 6:
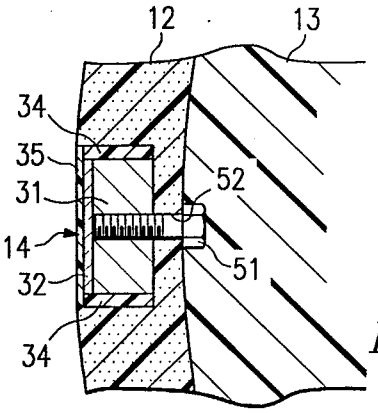
FIG. 6 is an enlarged fragmentary view, similar to FIG. 3, of a second embodiment of the invention.

Referring now to FIG. 6, wherein elements in common with FIG. 3 are identified with the same reference numerals, a second embodiment of the invention utilizes a plurality of titanium bolts 51, which are inserted from the underside of shield 12 through a plurality of openings 52 spaced apart along the bottom of groove 33, and into the bottom of anode bar 14 to provide a more positive mechanical bond between anode bar 14 and shield 12. After the bolts 51 are in place, the polyurethane cushion 13 can be formed in situ.

Figure 7:
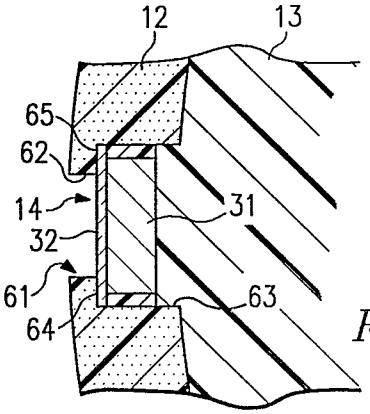
FIG. 7 is an enlarged fragmentary view, similar to FIG. 3, of a third embodiment of the invention.

Referring now to FIG. 7, another embodiment of the invention is illustrated. The anode groove is in the form of a slot 61 is cut through the thickness of shield 12, with the upper portion 62 of the slot 61 having a width less than the anode bar 14 while the lower portion 63 of the slot 61 has a width slightly greater than the width of anode bar 14, thereby forming shoulders 64 and 65. During the assembly of the cathodic protection device of this embodiment, anode bar 14 is placed in the lower portion 63 of slot 61 against shoulders 64 and 65, with the ceramic coating facing the upper portion 62 of slot 61. The polyurethane cushion 13 is then formed in place, effectively securing anode bar 14 in shield 12. If desired, the volume of upper portion 62 of slot 61 can be at least partially filled with a suitable sealer to protect ceramic coating 32.

Although a preferred embodiment of the invention has been described in the foregoing detailed description and illustrated in the accompany drawings, it will be understood that the invention is not limited to the embodiment disclosed, but is capable of numerous rearrangements, modifications, and substitutions of parts and elements without departing from the spirit of the invention. The present invention is therefore intended to encompass such rearrangements, modifications and substitutions of parts and elements as fall within the spirit and scope of the invention.

What is claimed is:

1. A cathodic protection device for hydraulic structures which comprises:

an elongated shield having a generally convex outer surface, when viewed along a plane perpendicular to the longitudinal axis of the shield, and an inner surface;

said inner surface of said shield being generally concave when viewed along a plane perpendicular to the longitudinal axis of said shield, such that said shield has the configuration of a segment of an annular wall which can flex upon being impacted by an external force;

said shield being a segment of a cylindrical pipe and the angle of inclusion of said segment being in the range of about 30° to about 180°;

said shield having an elongated groove in at least said generally convex outer surface with said groove extending at least generally parallel to said longitudinal axis;

an elongated anode having a substrate of a suitable valve metal and a coating on one face of said substrate, said coating being a suitable electrically conductive ceramic material, said anode being positioned in said shield such that said coating faces outwardly from said shield through said groove;

means for securing said shield to a hydraulic structure to be protected; and means for electrically connecting said anode to a suitable external source of electric power.

2. A cathodic protection device in accordance with claim 1 wherein the space defined by the inner concave surface of the shield and a plane through the lateral edges of the shield is at least partially filled with a resilient material to provide a cushioning of any impact blow against the convex outer surface of the shield.

3. A cathodic protection device in accordance with claim 2 wherein the segment has lateral edges lying in a plane parallel to the longitudinal axis of the tubular pipe.

4. A cathodic protection device in accordance with claim 3 wherein the angle of inclusion of said segment is in the range of about 45° to about 120°.

5. A cathodic protection device in accordance with claim 4 wherein said pipe is formed of spirally wound reinforcing filaments covered with a thermoplastic material.

6. A cathodic protection device in accordance with claim 5 wherein said filaments are glass fibers and said thermoplastic material is a polyester.

7. A cathodic protection device in accordance with claim 6 wherein said resilient material is polyurethane.

8. A cathodic protection device in accordance with claim 7 wherein said valve metal is one of titanium and niobium.

9. A cathodic protection device in accordance with claim 8 wherein said ceramic material is formed from a mixture of titanium oxide with at least one of ruthenium oxide and iridium oxide.

10. A cathodic protection device in accordance with claim 9 wherein the ruthenium and/or iridium constitutes from about 20% to about 80% of the metal atoms in the ceramic material, while titanium constitutes from about 80% to about 20% of the metal atoms in the ceramic material.

11. A cathodic protection device in accordance with claim 10 wherein said shield has first and second slotted openings therethrough adjacent its ends and spaced longitudinally from said anode, wherein said means for securing comprises first and second longitudinally adjustable clamps having concave inner surfaces mating with the convex outer surface of said shield, each clamp having a mounting bolt attached thereto and extending through a respective one of said first and second openings, the exterior surfaces of the clamps and the mounting bolts being electrically nonconductive, and wherein said inner conducting element of said electrical connector comprises a valve metal, with said another end of said conducting element being gold plated.

12. A cathodic protection device in accordance with claim 11 wherein said groove is slightly wider than said anode, and wherein a bonding agent is positioned between and in contact with said anode and the adjacent walls of the groove.

13. A cathodic protection device in accordance with claim 12 wherein said groove is slightly deeper than said anode.

14. A cathodic protection device in accordance with claim 11 wherein said groove is slightly wider than said anode, wherein a plurality of openings extend from the bottom of said groove through to the inner surface of said shield, and further comprising a plurality of fastening means, each extending from said inner surface of said shield through a respective one of said plurality of openings and into mechanical engagement with said anode.

15. A cathodic protection device in accordance with claim 11 wherein said groove extends from the outer surface of the shield to the inner surface of the shield, with the upper portion of the groove being narrower than the lower portion of the groove to form shoulders, said anode having a width greater than the width of the lower portion of the groove and less than the width of the upper portion of the groove, said anode being positioned in the lower portion of said groove and held against said shoulders.

16. A cathodic protection device in accordance with claim 10 wherein the ruthenium iridium constitutes from about 40% to about 50% of the metal atoms in the ceramic material, while titanium constitutes from about 60% to about 50% of the metal atoms in the ceramic material.

17. A cathodic protection device in accordance with claim 1 wherein said valve metal is one of titanium and niobium.

18. A cathodic protection device in accordance with claim 17 wherein said ceramic material is formed from a mixture of titanium oxide with at least one of ruthenium oxide and iridium oxide.

19. A cathodic protection device in accordance with claim 18 wherein the ruthenium and/or iridium constitutes from about 20% to about 80% of the metal atoms in the ceramic material, while titanium constitutes from about 80% to about 20% of the metal atoms in the ceramic material.

20. A cathodic protection device in accordance with claim 1 wherein said shield has first and second slotted openings therethrough adjacent its ends and spaced longitudinally from said anode, and wherein said means for securing comprises first and second longitudinally adjustable clamps having concave inner surfaces mating with the convex outer surface of said shield, each clamp having a mounting bolt attached thereto and extending through a respective one of said first and second openings, the exterior surfaces of the clamps and the mounting bolts being electrically nonconductive.

21. A cathodic protection device in accordance with claim 1 wherein said groove is slightly wider than said anode, wherein a plurality of openings extend from the bottom of said groove through to the inner surface of said shield, and further comprising a plurality of valve metal fastening means, each extending from said inner surface of said shield through a respective one of said plurality of openings and into mechanical engagement with said anode.

22. A cathodic protection device in accordance with claim 1 wherein said groove extends from the outer surface of the shield to the inner surface of the shield, with the upper portion of the groove being narrower than the lower portion of the groove to form width of the lower portion of the groove and less than the width of the upper portion of the groove, said anode being positioned in the lower portion of said groove and held against said shoulders.

23. The elongated anode of claim 1 wherein said electrical connecting means is an electrical connector attached to said inner surface of said shield, said electrical connector comprising an inner electrically conducting element and an outer electrically non-conducting element surrounding said conducting element, said conducting element having one end electrically connected to said anode and another end connected to a suitable external source of electrical power.

24. The cathodic protection device of claim 1 comprised of an anode element of elongated strip of a suitable valve metal with a continuous coating on its outer surface of an electrically conductive ceramic material.

25. The anode element of claim 24 wherein said valve metal strip has a thickness ranging from about 0.05 to about 0.5 inch.

26. The anode element of claim 24 wherein the ratio of the length of said elongated strip to its width is within the range of about 20:1 to about 2000:1.

27. The anode element of claim 26 wherein the ratio of the length of said elongated strip to its width is within the range of about 50:1 to about 1000:1.

28. A cathodic protection device in accordance with claim 24 wherein said continuous coating of ceramic material is applied over the outer surface of the valve metal by reactive ion plating of at least one layer.

29. The cathodic protection device of claim 28 wherein said continuous coating ranges in thickness between 0.001 to 0.50 inch.

30. A cathodic protection device in accordance with claim 1 wherein titanium constitutes from about 90% to about 99.5% of the metal atoms in the ceramic material, while niobium constitutes from about 10% to 0.5% of the metal atoms in the ceramic material.

* * * * *